US005379691A

United States Patent [19]

Hamu et al.

[11] Patent Number: 5,379,691

[45] Date of Patent: Jan. 10, 1995

[54] SCREEN PRINTING FRAME ASSEMBLY WITH SCREEN ANCHORS

[76] Inventors: Alan J. Hamu; Kaino J. Hamu, both of 16061 Dominica Cir., Huntington Beach, Calif. 92649

[21] Appl. No.: 944,223

[22] Filed: Sep. 14, 1992

[51] Int. Cl.[6] ..... B41L 13/02

[52] U.S. Cl. ..... 101/127.1; 101/392

[58] Field of Search ..... 101/127, 127.1, 128, 101/128.1, 114, 391, 392; 160/372, 374, 375; 38/102, 102.1, 102.91; 69/19.1

[56] References Cited

U.S. PATENT DOCUMENTS

| | | | |
|---|---|---|---|
| 2,545,277 | 3/1951 | Hannah et al. | 101/127.1 |
| 2,588,199 | 3/1952 | Bily | 101/127.1 |
| 3,541,957 | 11/1970 | Bubley | 101/127.1 |
| 3,788,216 | 1/1974 | Lambert | 101/127.1 |
| 4,442,772 | 4/1984 | Bubley | 101/127.1 |

FOREIGN PATENT DOCUMENTS

| | | | |
|---|---|---|---|
| 1188301 | 12/1957 | France | 101/127.1 |
| 2307993 | 8/1979 | Germany | 101/127.1 |
| 0105834 | 11/1942 | Sweden | 101/127.1 |
| 0620629 | 3/1949 | United Kingdom | 101/127.1 |
| 0641996 | 8/1950 | United Kingdom | 101/127.1 |

*Primary Examiner*—Edgar S. Burr
*Assistant Examiner*—Christopher A. Bennet
*Attorney, Agent, or Firm*—Boniard I. Brown

[57] ABSTRACT

A screen frame assembly for mounting a printing screen includes a rectangular screen frame proper having a rectangular opening, and screen anchor members removably secured to frame anchor members along the four sides of the frame opening and having bonding surfaces to be adhesively or otherwise bonded to the screen edges for securing the screen to the frame. The screen anchor members are separable from the frame anchor members to clean the screen anchor members for reuse and to replace screen anchor members which are damaged or otherwise unusable.

10 Claims, 3 Drawing Sheets

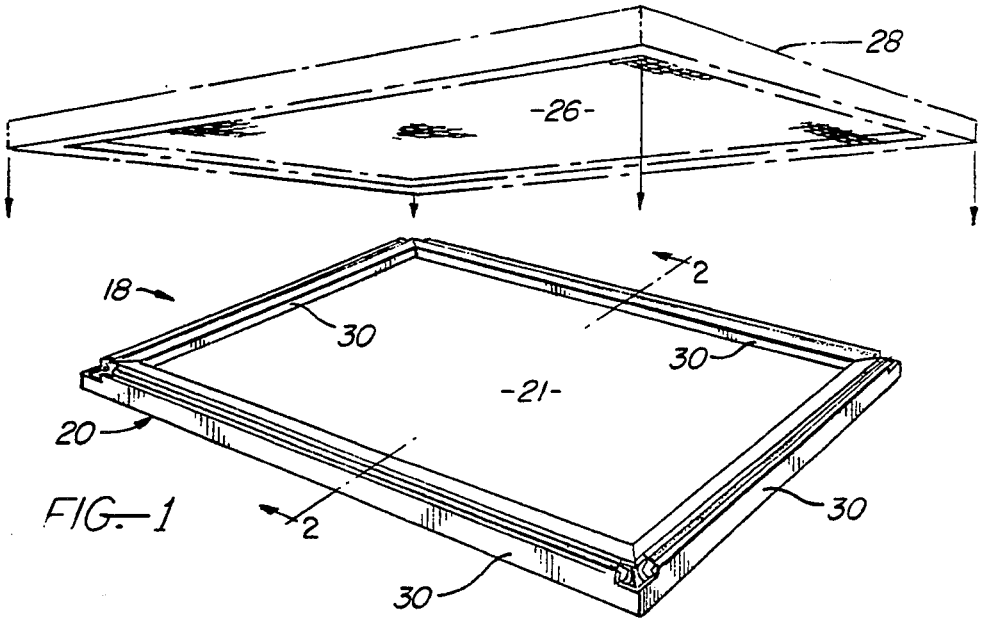
FIG.-1
FIG.-2
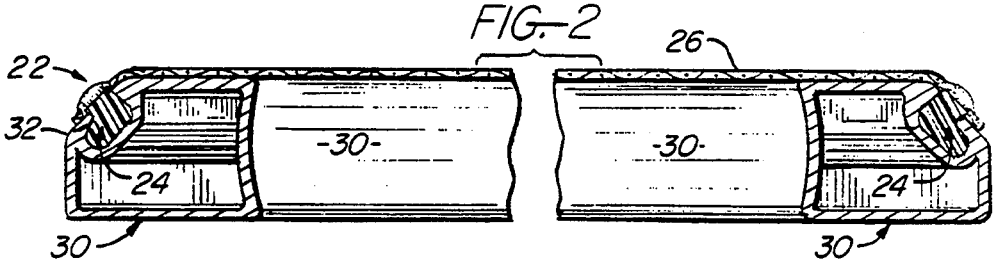
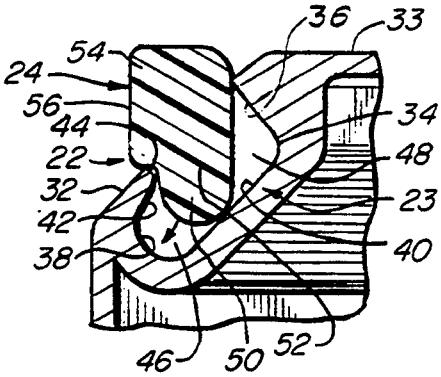
FIG.-3
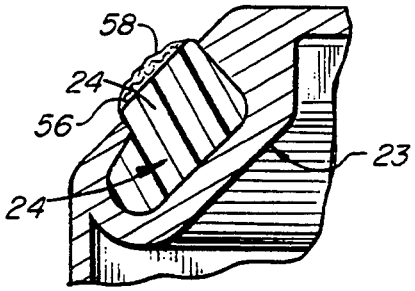
FIG.-4
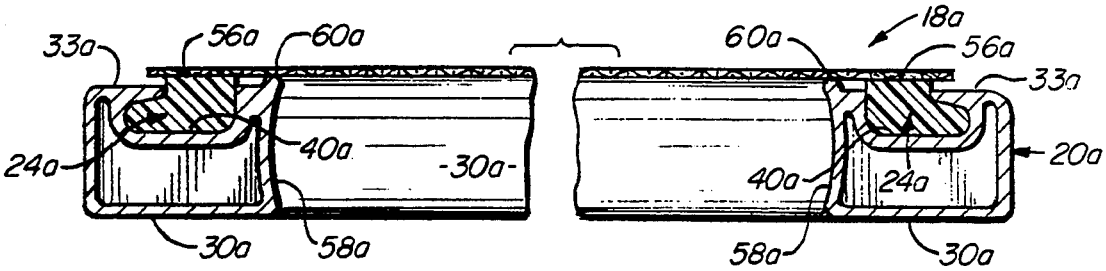
FIG.-4A

SCREEN PRINTING FRAME ASSEMBLY WITH SCREEN ANCHORS

BACKGROUND OF THE INVENTION

1. Field of the Invention

This invention relates generally to apparatus for practicing the printing process commonly known as silk screen printing and more particularly to an improved screen frame assembly for mounting the printing screen used in this printing process.

2. Prior Art

The printing technique commonly called silk screen printing and referred to herein simply as screen printing, is well understood and widely used for a great variety of printing applications. Screen printing involves the use of a fine mesh printing screen which has been processed to block selected holes in the screen in such a way that the blocked and open screen holes define the image to be printed. The printing screen is stretched taut across a screen frame which is then placed over the work surface to be printed with the underside of the screen in contact with the surface. A screen printing ink is wiped across the upper side of the screen to force the ink through the open screen holes onto the work surface and thereby reproduce the screen image on the surface.

A printing screen is mounted on a screen frame in either of two basic ways. According to one way, the screen is stretched taut across and secured along its edges to a separate stretch frame. The stretch frame and its taut screen are placed over a screen frame, and the screen edges are secured to the side members of the screen frame. The stretch frame is then removed from the screen, leaving the tautly stretched screen on the screen frame. Another way of mounting a printing screen involves the use of a screen frame having screen anchor members, such as rollers, draw bars, or the like. The screen edges are secured to these anchors which are then rotated, in the case of screen anchor rollers, or moved laterally outward, in the case of draw bars, to stretch the screen edgewise across the screen frame.

The prior art is replete with a vast assortment of printing screen frames. By way of example, U.S. Pat. No. 4,409,749 discloses a screen frame having rollers to which the screen edges are secured and which are rotatable to stretch the screen across the screen frame. U.S. Pat. No. 3,553,862 discloses a screen frame having draw bars to which the screen edges are secured and which are movable laterally to tension the screen on the screen frame. In U.S. Pat. No. 3,167,004, a stencil screen is initially stretched taut and then secured to a screen frame.

A printing screen is fixed to a screen frame in various ways. In U.S. Pat. Nos. 3,553,862 and 4,409,749, for example, the screen is releasibly gripped by screen anchors on the frame. In U.S. Pat. No. 3,167,004, the screen is attached to the frame by a fushion bond. U.S. Pat. No. 4,702,783 discloses a process for adhesively bonding a pre-stretched printing screen to a screen frame using a cyanoacrylate based adhesive and catalyst.

SUMMARY OF THE INVENTION

This invention provides an improved printing screen frame assembly including a printing frame proper and novel screen anchor means for securing a printing screen to the frame. The anchor means comprise anchor members, referred to herein as frame anchors, on the frame, additional discrete anchor members, referred to as screen anchors, to be adhesively or otherwise bonded to the edges of the printing screen, and means releasably securing the screen anchors to the frame anchors in fixed positions relative to the frame anchors wherein the screen anchors are disposed for bonding contact with the printing screen. The preferred frame anchors contain longitudinal channels which removably receive the screen anchors. The screen anchors and channels have complementary shapes which retain the screen anchors in a fixed position about and laterally of the axes of their channels.

One advantage of the invention resides in the fact that the screen anchors may be removed from the screen frame to permit cleaning the bonding material from the anchors. Moreover, the screen anchors may be replaced if damaged or otherwise rendered unusable or merely to eliminate the neccessity of separating the screen anchors from the printing screen and cleaning adhesive from the screen anchors after each use to avoid excessive adhesive buildup on the anchors. The invention also avoids the necessity of cleaning adhesive from the frame.

One disclosed screen frame assembly of the invention is designed to mount a printing screen which is pre-stretched and fixed to a stretch frame. This frame assembly has a screen frame proper comprising four rigid frame members joined end-to-end at the four corners of the frame to from a rigid rectangular frame structure. These frame members also constitute the frame anchors of the frame assembly printing screen anchor means. The screen anchors of the frame assembly are relatively long and slender members which are releasably secured to the frame anchors and are adapted to be secured to a printing screen which is pre-stretched across the frame. In other disclosed embodiments, the frame anchor members are screen tensioning members mounted on the screen frame for movement relative to the frame, and the screen anchor members are releasably secured to these movable frame anchor members. A printing screen attached to the screen anchors is stretched while on the screen frame by moving the the frame anchors relative to the frame. The screen anchors in these disclosed embodiments are inserts which are releasably engagable in grooves or channels in the frame anchors.

A further aspect of the invention is concerned with a metallic screen frame for mounting a metallic printing screen in such a way that an electrical current may be directed through the screen to heat the screen during printing for the purpose of heating the printing ink. Heating the ink in this way reduces its viscosity and produces superior screen prints in many printing applications. According to this aspect of the invention, the printing screen is electrically isolated in a unique way from the screen frame and has terminal portions to be connected to an electrical power source for impressing a voltage across and thereby producing electrical current flow through the screen to heat the latter.

BRIEF DESCRIPTION OF THE DRAWINGS

FIG. 1 is a perspective view showing an improved screen frame assembly according to this invention and a stretch frame mounting a pre-stretched printing screen to be mounted on the screen frame assembly;

FIG. 2 is an enlarged section taken on line 2—2 in FIG. 1;

FIGS. 3 and 4 are fragmentary enlargements of the left side of the screen frame in FIG. 2, illustrating a screen anchor of the frame assembly and the manner in which the anchor is engaged with and disengaged from its frame anchor of the frame assembly;

FIG. 4A is a section similar to FIG. 2 through a modified screen frame assembly according to the invention;

DESCRIPTION OF THE PREFERRED EMBODIMENTS

Figure 5:
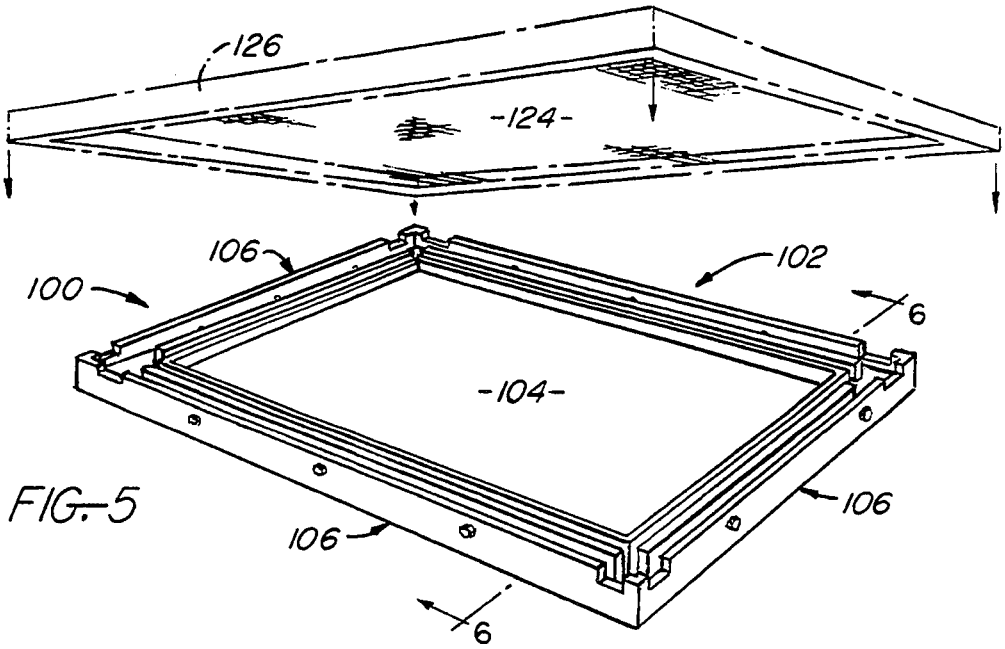
FIG. 5 is a perspective view of a modified screen frame assembly according to the invention.

Turning now to these drawings and first to FIGS. 1-4, there is illustrated an improved screen frame assembly 18 according to the invention. This frame assembly includes a screen frame 20 proper having a central rectangular opening 21, and screen anchor meats 22 for securing a printing screen to the frame. Screen anchor means 22 includes anchor members 23, referred to herein as frame anchor members or simply frame anchors, on the screen frame 20 and discrete anchor members 24, referred to herein as screen anchor members or simply screen anchors, releasably secured to the frame anchors. Frame 20 is adapted to receive a printing screen 26 in a position wherein the screen is stretched tautly across the normally bottom side of the frame (the upper frame side in the drawings) and is secured along its edges to the frame by the screen anchor means 22 in the manner described below.

As is well understood by those skilled in the screen printing art, the printing screen 26 is a fine mesh screen which is processed in various ways to block selected holes in the screen such that the open and blocked screen holes define the image to be printed. This image is printed on a work surface by placing the frame in a position wherein the screen is located at the bottom of the frame and in contact with the work surface. A screen printing ink is then spread across the upper side of the screen in such a way that the ink is forced through the open screen holes onto the work surface to form the screen image on the work surface.

The particular screen frame 20 illustrated is designed to receive a printing screen 26 which has been pre-stretched to a desired tautness and secured along its edges to a stretch frame 28. To his end, the screen frame 20 comprises relatively rigid frame members 30 which are disposed along the sides, respectively, of the frame opening 21 and are welded or otherwise rigidly joined end-to-end at the four corners of the frame to form a rigid rectangular frame structure. The frame members 30 form the frame anchors 23. The screen anchors 24 arm adapted to be secured to the pre-stretched printing screen 26 along its edges, inwardly of the stretch frame 28, and to releasably engage the frame anchors 23 in such a way as to firmly secure the pre-stretched printing screen to the frame 20. The frame members 30 illustrated are aluminum extrusions of generally rectangular tubular shape in cross-section including inclined longitudinal edge portions which form the screen anchors 23. These anchors have laterally outer, tapered or beveled edge surfaces 32 which intersect the laterally inner normally bottom surfaces 33 of the frame members (i.e. the upper surfaces in the drawings).

The screen anchors 24 are removable inserts positioned within frame anchor channels 34 which enter the beveled outer surfaces 32 of the frame anchors 23 and extend longitudinally of the frame members 30. Each channel 34 has an inner edge wall 36 nearest the central frame opening, an opposite rounded concave outer-edge wall 38, a bottom wall 40 extending between the edge walls 36, 38, and an outer side wall 42 opposite and spaced from the bottom wall 40 and extending from the outer edge wall 38 toward the inner edge wall 36. The outer side wall terminates in a longitudinal edge 44 which is spaced from the inner edge wall 36 to form between the edge wall 36 and the edge 44 a side opening to the channel 34 which opens outwardly through the beveled surface 32 of the respective frame anchor 23. Each channel 34 thus has a closed longitudinal portion 46 bounded by the outer edge wall 38, the bottom wall 40, and the outer side wall 42, and an opposite longitudinal portion 48 which opens laterally through the respective beveled surface 32.

Each screen anchor 24 is an elongate insert removably positioned within its respective frame anchor channel 40 and having a foot-like shape in transverse cross-section which substantially complements the transverse cross-section of the channel. Thus, each screen anchor has a rounded longitudinal toe portion 50, a partially rounded longitudinal heel portion 52, and a longitudinal ankle-like portion 54 having a longitudinal adhesive bonding surface 56. Each screen anchor 24 is insertable into its frame anchor channel 34 by first inserting its toe portion 50 through the open side of the channel into the closed channel portion 46, as depicted in FIG. 3, and then pressing the heel portion 52 of the screen anchor into the channel until the screen anchor occupies its fully inserted position of FIG. 4 in the channel. In this fully inserted position, each screen anchor 24 fits snugly within and completely fills its frame anchor channel 34. The ankle portion 54 of each screen anchor then projects through the open side of its frame anchor channel and slightly beyond (above as viewed in the drawings) the adjacent beveled frame anchor surface 32. The outer surface 56 of each frame anchor then parallels and is slightly raised (as viewed in the drawings) relative to the adjacent beveled frame surface 32. The screen anchors 24 and frame anchor channels 34 are preferably so sized and shaped that the screen anchors engage in their frame anchor channels with a slight snap fit which firmly retains the anchor members in the channels, and to this end may be slightly resilient. The screen anchors may be pried or otherwise forced from the frame anchor channels.

As mentioned earlier, the screen frame 20 is adapted to receive a pre-stretched printing screen 26 secured to a stretch frame 28. The inside dimensions of the stretch frame 28 are somewhat larger than the outside dimensions of the screen frame 20. The stretch frame and its screen may be thus be pressed downwardly over the normally bottom side (upper side as viewed in the drawings) of the screen frame 20 to place the outer perimeter of the stretched screen portion within the central opening in the stretch frame in contact with the bottom surfaces 33 (top surfaces in the drawings) of the screen frame 20 and with the surfaces 56 of the screen anchors 23. The screen frame assembly 20 is designed to be secured to the screen 26 by first applying a suitable adhesive 58 (FIG. 4) to the screen anchor surfaces 56, then pressing the stretch frame 28 and screen 26 downwardly over the screen frame, in the manner just described, to place the screen perimeter in adhesive bonding contact with the adhesively coated screen anchor surfaces 56, retaining the screen in this position until the adhesive sets to firmly bond the screen to the screen anchors, and finally severing or otherwise removing the stretch frame 28 from the screen. It will be observed that the shape of the screen anchors 24 and the frame anchor channels 34 are such that the edgewise tension in the stretched screen 26 cannot dislodge the anchor members from the channels.

An important advantage of the invention resides in the fact that the lower surfaces 33 of the frame members 30 provide coplanar screen support surfaces which support the printing screen 26 between the screen anchors 24 and the frame opening 21 to firmly retain the screen in a planar printing configuration and locate the screen vertically relative to the screen frame 18. Adhesive 58 is applied only to the screen anchors 24. These anchors are removable from the screen frame 20 in the manner described below and, if damaged or otherwise rendered unusable, may be replaced by new screen anchors. The screen anchors may also be replaced after use to eliminate the necessity of separating them from the printing screen and cleaning adhesive from the anchors to make them reusable.

The printing screen 26 may be removed from the screen frame 20 and from the screen anchors 24 in any convenient way. For example, removal of the screen may be accomplished by slicing the screen into four separate flap-like portions each secured along its outer edge to a screen anchor. Each of these screen portions is then turned or folded outwardly to a position in which it is located outwardly beyond the adjacent edge of the frame. Finally, each screen portion is pulled outwardly away from the frame in such a way as to rupture the adhesive bond between and thereby part the screen portion and its respective screen anchor. The screen anchors 24 may then be pulled, pried or otherwise removed from the frame anchor channels 34 for reuse after cleaning adhesive from the anchors, if necessary, or for replacement by new screen anchors. In this regard, the ends of the frame anchor channels 40 open endwise at the four corners of the frame 20 to permit the anchors to be pushed endwise from the channels. If desired, the screen anchors may contain holes opening through their adhesive bonding surfaces 56 to receive implements for pulling the anchors laterally from their channels.

The improved screen frame assembly **18*a* of FIG. 4A is identical to screen frame assembly 18 of FIGS. 1–4 except as noted below. The parts of the frame assembly 18*a* are designated by the same reference numerals, with the subscript a as their corresponding parts in FIGS. 1–4. The screen frame assembly 18*a* differs from the screen frame assembly 18 in that the beveled surfaces 32 of the screen frame 20 are omitted in the modified screen frame 20*a*. The frame members 30*a* of the screen frame 20*a* have normally bottom surfaces 33*a* (upper surfaces in the drawings) disposed in a common plane parallel to the plane of the frame. The screen anchors 24*a* of the screen frame 20*a* are positioned within frame anchor channels 40*a* which enter the surfaces 33*a*. The screen anchors 24*a* and their frame anchor channels 40*a* are identical in cross-section to those of FIGS. 1–4. The screen anchors 24*a* have longitudinal adhesive, bonding surfaces 56*a*. The inner frame member side walls 58*a* have edges 60*a* which are disposed in a common plane parallel to but spaced slightly above (as viewed in the drawings) the frame member surfaces 33*a* and containing the screen anchor bonding surfaces 56*a*. The screen frame assembly 18*a* is otherwise essentially identical to that of FIGS. 1–4. A pre-stretched printing screen mounted on a stretch frame is adhesively secured to the screen frame 20*a* by applying adhesive to the screen anchor member bonding surfaces 56*a*, then pressing the stretched screen downwardly over the screen frame 20*a* to press the screen firmly against the adhesively coated screen anchor bonding surfaces 56*a* until the adhesive sets , and thorn severing the stretch frame from the screen in essentially the same way as explained in connection with FIGS. 1–4. The lower frame edges 60*a* provide coplanar screen support surfaces which support the printing screen between the screen anchors 24*a*** and the frame opening to firmly retain retain the screen in a planar printing configuration and locate the screen vertically relative to the screen frame.

Figure 6:
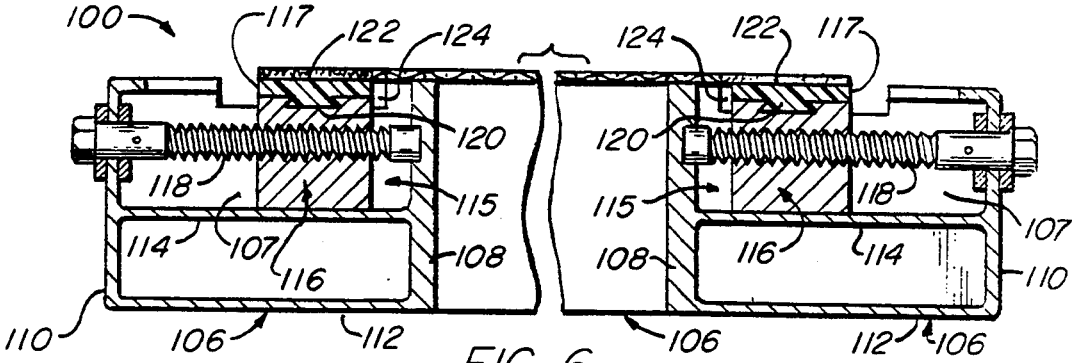
FIG. 6 is an enlarged section taken on line 6—6 in FIG. 5.

The improved screen frame assembly 100 of FIGS. 5 and 6 includes a rigid rectangular screen frame 102 having a central rectangular opening 104 and rigid frame members 106 along the edges of this opening rigidly joined end to end at the corners of the frame to form a rigid rectangular frame structure. The frame members 106 comprise extrusions containing channels 107 which open laterally through the normally bottom side (the upper side in the drawings) of the frame. The frame members include laterally inner and outer side walls 108, 110 at opposite sides of the channels 107 which face edgewise of the frame and connecting walls 112, 114 parallel to the plane of the frame and integrally joining the side walls.

The frame assembly 100 includes printing screen anchor means 115 for securing a printing screen to the screen frame 102. These anchor means comprise frame anchors in the form of draw bars 116 and screen anchors 117 releasably secured to the draw bars. The draw bars extend longitudinally through the frame member channels 107 and are movable laterally toward and away from the frame opening 104 by screws 118 rotatably journalled in the frame member side walls 108, 110 and threaded in the draw bars. The screen anchors 117 are strip-like inserts having dove-tailed tongues 120 which slide in dove-tailed grooves in the normally bottom edges (upper edges in the drawings) of the draw bars. The normally bottom edges (upper edges in FIG. 6) of the inner frame member side walls 108 provide coplanar screen support surfaces which serve the same purpose as the screen support surfaces in FIGS. 1–4A. These screen support surfaces and the normally bottom longitudinal surfaces 122 (upper surfaces in the drawings) of the screen frame anchors or inserts 117 are disposed in a common plane parallel to the plane of the screen frame. The frame members 106 have cutouts 124 to permit endwise insertion and removal of the screen anchor inserts into and from the draw bar grooves.

In this embodiment of the invention, the edges of a printing screen 124 are adhesively bonded to the screen anchor surfaces 122, which are adhesive bonding surfaces, by applying an adhesive to and holding the screen in firm contact with these surfaces until the adhesive sets. If desired, the printing screen may be initially mounted in a support frame 126 to aid in holding screen in contact with the adhesive bonding surfaces 122 until the adhesive sets. The support frame is then removed from the screen. At this point, the draw bars 116 are moved laterally outward to stretch the screen to the proper tautness while the screen is on the frame.

The printing screen 124 is removed from the frame 102 and from the screen anchors 117 by slicing the screen into four separate flap-like portions each secured to a frame anchor, then folding the screen portions upwardly over the frame, and finally pulling the screen portions upwardly to rupture the adhesive bond between and thereby separate the screen and anchor. The screen anchors may then be removed endwise from their respective drawbars for cleaning and reuse or for replacement.

Figure 7:
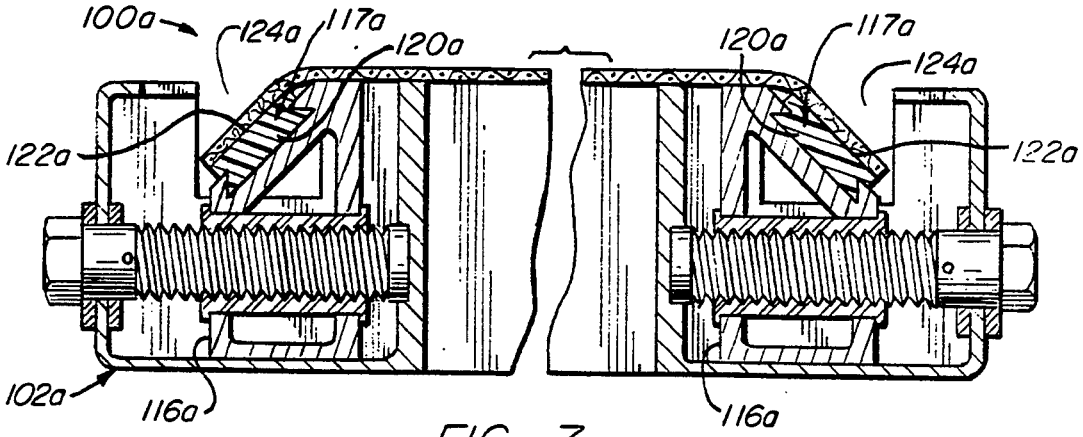
FIG. 7 is an enlarged section similar to FIGS. 6 through a further modified screen frame assembly according to the invention.

The improved screen frame assembly 100*a* of FIG. 7 is similar to that of FIGS. 5 and 6 except as noted below, and the parts of the frame assembly 100*a* are designated by the same reference numerals, with the subscript a, as their corresponding parts in FIGS. 5 and 6. Unlike the frame anchor draw bars 116 in FIGS. 5 and 6, the frame anchor draw bars 116*a* in FIG. 7 have laterally outer beveled sides. The screen anchors 117*a* are elongate inserts which are removably secured to the beveled sides of the draw bars 116*a* by dove-tailed tongues 120*a* slidable in dove-tailed grooves in the beveled sides of the draw bars. The screen frame assembly is otherwise essentially identical to that of FIGS. 5 and 6. The screen anchor members 117*a* are removable endwise from and replaceable endwise on the draw bars 116*a* through notches 124*a* in the screen frame members 106*a*. A printing screen is adhesively bonded along its edges to the adhesive bonding surfaces 122*a* of the screen anchors 117*a* and is the then stretched edgewise across the normally bottom side (the upper side in the drawings) of the frame screen frame 102*a*, in contact with the coplanar normally lower drawbar surfaces and the normally lower edges (screen support surfaces) of the inner frame side walls, by moving the draw bars 116*a* laterally outward.

Figure 8:
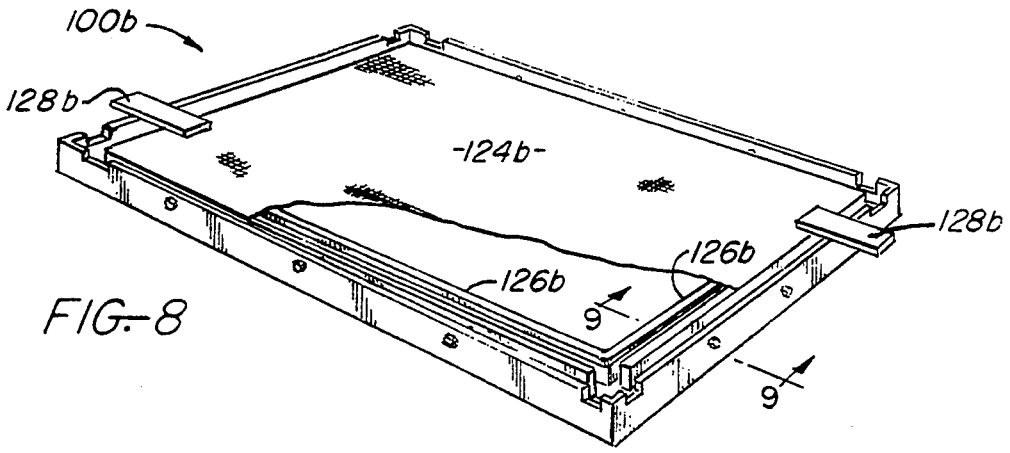
FIG. 8 is a perspective view of a further modified screen frame according to the invention.
Figure 9:
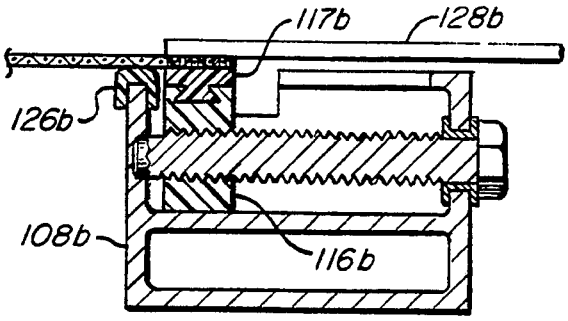
FIG. 9 is an enlarged section taken on line 9—9 in FIG. 8.

The improved screen frame assembly 100*b* of FIGS. 8 and 9 is designed for use with a metallic printing screen 124*b* which is electrically hearted during printing to reduce the viscosity of the screen printing ink to enhance the screen prints in certain screen printing applications. The improved screen frame assembly 100*b* is identical to that of FIGS. 5 and 6 except for electrical insulation of the metallic screen from the metallic screen frame. The parts of the frame assembly 100*b* are designated by the same reference numerals, with the subscript b, as their corresponding parts in FIGS. 5 and 6. The screen frame assembly 100*b* differs from that of FIG. 6 only in two respects. First, electrical insulators 126*b* in the form of plastic caps are mounted over the normally lower edges (upper edges in the drawings) of the frame member inner side walls 108*b*. Secondly, the screen anchors 117*b* and/or the frame frame anchor draw bars 116*b* are also constructed of plastic or other electrically non-conductive material. The caps 12*b* and screen anchors 117*b* electrically insulate the metallic printing screen 124*b* from the metallic screen frame proper. Along opposite edges of the screen are electrical terminals 128*b* for connection to an electrical voltage source for producing an electrical current flow through the screen to heat the latter. As shown in FIG. 9, the normally lower surfaces of the caps 126*b* (upper cap surfaces in the drawings) provide coplanar screen support surfaces which, and the normally lower bonding surfaces (upper surfaces in the drawings) of the screen anchors 117*b*, are located in the common plane of the screen frame.

Figure 10:
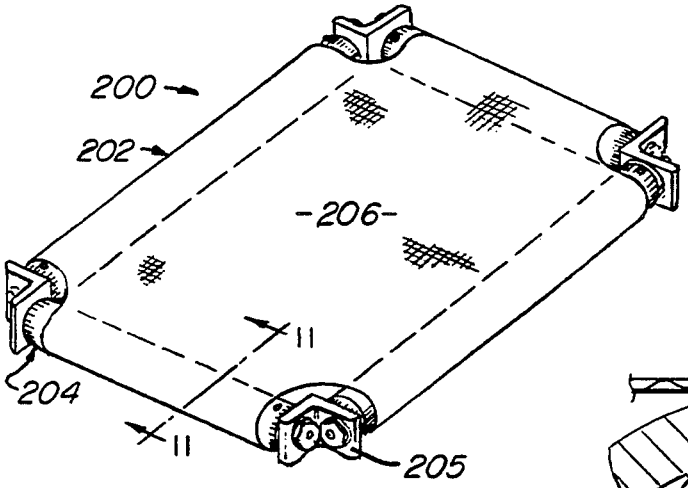
FIG. 10 is a perspective view of a further modified screen frame according to the invention.
Figure 11:
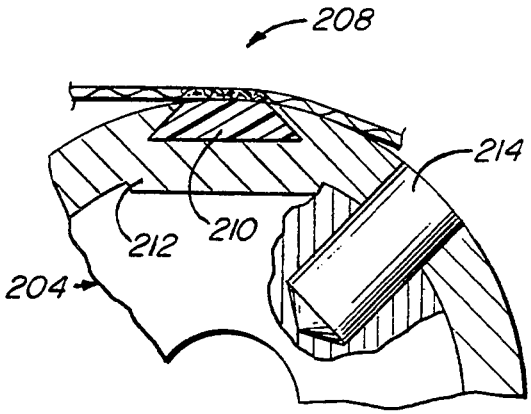
FIG. 11 is an enlarged section taken on line 11—11 in FIG. 10.

The improved frame assembly 200 of FIGS. 10 and 11 comprises a screen frame 202 including screen tensioning rollers 204 rotatably mounted at their ends in brackets 205 at the frame corners. The frame is adapted to mount a printing screen 206 whose edges are attached to the rollers by screen anchor means 208. Screen anchor means 208 include frame anchors which are formed by the rollers and screen anchors 210. These screen anchors comprise strip-like inserts which are slidably positioned within laterally opening channels 212 in the rollers. The screen anchors 210 and frame anchor channels 212 have mating dove-tailed shapes in transverse cross-section. The edges of the printing screen 206 are adhesively bonded to the screen anchor inserts 210 which are removable endwise from and insertable endwise into the frame anchor channels 212 for the same reasons as the earlier described screen anchors. Except for the screen anchor means 208, the screen frame is conventional. The frame anchor rollers 204 are rotatable to stretch the printing screen across the frame by a shaft inserted into holes 214 in the rollers and are then releasably secured against rotation by the illustrated nuts at the roller ends.

It is now evident that in each embodiment of the invention, the screen anchors have bonding surfaces to which the screen edges are adhesively or otherwise bonded. The screen anchors are secured to the frame anchors fixed positions in relative to the frame anchors, wherein the screen anchor bonding surfaces are disposed for proper bonding contact with the printing screen. In the disclosed frame assembly embodiments, the screen anchors and the frame anchor channels have complementary shapes in transverse cross-section which retain the screen anchors in fixed positions about and laterally of the longitudinal axes of their respective channels wherein the screen anchor bonding surfaces are exposed at the normally bottom screen side of the screen frame for proper bonding contact with the printing screen. Preferably, the screen anchors are positioned so that their bonding surfaces are slightly raised relative to the frame anchor frame members in the frame assembly arrangement of FIGS. 1–4A. The screen anchors seat on the frame anchor draw bars in the frame assembly arrangement of FIGS. 5–9. The screen anchor bonding surfaces are substantially flush with the frame anchor roller surfaces in the frame assembly arrangement of FIGS. 10 and 11.

According to the preferred practice of the invention, the removable screen anchors are constructed of a plastic material, and the printing screen is adhesively bonded to the screen anchors. The preferred screen anchor plastics and adhesives are selected from the following plastic and adhesive groups which provide a sufficiently strong bond between the screen and anchors to withstand the tension in the screen. PLASTIC GROUP: ABS, acrylic, epoxy, nylon, thermoset polyester, thermoplastic polyester, polycarbonate, polyvinyl chloride, polyurethane, styrene-acrylonitrile. ADHESIVE GROUP: instant adhesives, acrylic adhesives, anaerobic adhesives.

I claim:

1. A printing screen frame assembly comprising:

an open rectangular screen frame having four corners, normally upper and lower sides, and a rectangular frame opening which opens through said frame sides, and said frame including four elongate frame members joined end to end at said corners and surrounding said opening, an elongate screen anchor extending lengthwise of each frame member and having a longitudinal side forming a planar screen bonding surface, means removably mounting each screen anchor on its respective frame member in a position wherein said bonding surface of the respective screen anchor is exposed at the lower side of said frame, and wherein said means removably mounting each screen anchor on its respective frame member comprises a channel extending longitudinally of the respective frame member and having an open longitudinal side at said lower side of said frame opening through an adjacent surface of said frame assembly, and said channel removably receiving the respective screen anchor with said longitudinal side of the respective screen anchor projecting laterally outwardly through said open longitudinal side of said channel and beyond said adjacent surface of said frame assembly to locate the entire bonding surface of the respective screen anchor beyond said adjacent surface, said frame members have screen support surfaces at said lower side of said frame between said frame opening and said screen anchors and disposed in a common plane parallel to said frame sides, and said screen anchors are arranged on said frame to locate said bonding surfaces in one of the following positions (a), (b) relative to said frame: (a) positions in which said bonding surfaces are located in said common plane of said screen support surfaces and face in the normally downward direction of said frame, (b) positions in which the bonding surfaces are located between said common plane of said screen support surfaces and the upper side of said frame and face at an acute angle relative to said common plane.

2. A frame assembly according to claim 1 wherein:

said bonding surfaces are located in said positions (a).

3. A frame assembly according to claim 1 wherein:

said bonding surfaces are located in said positions (b).

4. A frame assembly according to claim 1 wherein:

said frame members have laterally outer beveled surfaces at said lower side of the frame disposed at said acute angle relative to said common plane of said screen support surfaces, and laterally inner coplanar surfaces of said lower side of the frame between said beveled surfaces and said frame opening, said laterally outer beveled surfaces form said adjacent surfaces of said frame assembly and said laterally inner surfaces form said screen support surfaces, each channel extends longitudinally through a frame member and opens laterally through said beveled surface of the respective frame member, and said bonding surface of each screen anchor substantially parallels said beveled surface of the respective frame member, whereby said screen anchors are arranged on said frame to locate said bonding surfaces in said positions (b).

5. A frame assembly according to claim 1 wherein:

said frame members have laterally outer surfaces at said lower side of the frame parallel to and located between said common plane and said upper frame side, and laterally inner surfaces at said lower side of the frame between said laterally outer surfaces and said frame opening, said laterally outer surfaces form said adjacent surfaces of said frame assembly and said laterally inner surfaces form said screen support surfaces, each channel extends longitudinally through a frame member and opens laterally through said laterally outer surface of the respective frame member, and said bonding surface of each screen anchor is positioned in said common plane, whereby said screen anchors are arranged on said frame to locate said bonding surfaces in said positions (a).

6. In combination:

a printing screen, an open rectangular screen frame having four corners, normally upper and lower sides, and a rectangular frame opening which opens through said frame sides, and said frame including four elongate frame members joined end to end at said corners and surrounding said opening, an elongate screen anchor extending lengthwise of each frame member and having a longitudinal side forming a planar screen bonding surface, means removably mounting each frame anchor on its respective frame member in a position wherein said bonding surface of the respective screen anchor is exposed at the lower side of said frame, and wherein said means removably mounting each screen anchor on its respective frame member comprises a channel extending longitudinally of the respective frame member and having an open longitudinal side at said lower side of said frame opening through an adjacent surface of said frame assembly, and said channel removably receiving the respective screen anchor with said longitudinal side of the respective screen anchor projecting laterally outwardly through said open longitudinal side of said channel and beyond said adjacent surface of said frame assembly to locate the entire bonding surface of the respective screen anchor beyond said adjacent surface, said frame members have screen support surfaces at said lower side of said frame between said frame opening and said screen anchors and disposed in a common plane at said lower side of said frame said screen anchors are arranged on said frame to locate said bonding surfaces in one of the following positions (a), (b) relative to said frame: (a) positions in which said bonding surfaces are located in said common plane of said screen support surfaces and face in the normally downward direction of said frame, (b) positions in which the bonding surfaces are located between said common plane of said screen support surfaces and the upper side of said frame and face at an acute angle relative to said common plane, and said printing screen is bonded to said screen anchor bonding surfaces and extends across the lower side of said frame in contact with said screen support surfaces between said frame opening and said screen anchors.

7. The combination according to claim 6, wherein:

said means removably mounting each screen anchor on its respective frame member comprises a channel extending longitudinally of the respective frame member and having an open longitudinal side at said lower side of said frame and removably receiving the respective screen anchor with said longitudinal side of the respective screen anchor projections through said open longitudinal side of said channel.

8. The combination according to claim 7, wherein:

said channels have open ends through which said screen anchors are insertable into and removable from said channels.

9. A frame assembly according to claim 6 wherein:

said frame members have laterally outer beveled surfaces at said lower side of the frame disposed at said acute angle relative to said common plane of said screen support surfaces, and laterally inner coplanar surfaces at said lower side of the frame between said beveled surfaces and said frame opening, said laterally outer beveled surfaces form said adjacent surfaces of said frame assembly and said laterally inner surfaces form said screen support surfaces, each channel extends longitudinally through a frame member and opens laterally through said beveled surface of the respective frame member, and said bonding surface of each screen anchor substantially parallels said beveled surface of the respective frame member, whereby said screen anchors are arranged on said frame to locate said bonding surfaces in said positions (b).

10. A frame assembly according to claim 6 wherein:

said frame members have laterally outer surfaces at said lower side of the frame parallel to and located between said common plane and said upper frame side, and laterally inner surfaces at said lower side of the frame between said laterally outer surfaces and said frame opening, said laterally outer surfaces form said adjacent surfaces of said frame assembly and said laterally inner surfaces form said screen support surfaces, each channel extends longitudinally through a frame member and opens laterally through said laterally outer surface of the respective frame member, and said bonding surface of each screen anchor is positioned in said common plane, whereby said screen anchors are arranged on said frame to locate said bonding surfaces in said positions (a).

* * * * *